US008629752B2

(12) United States Patent
Jeong et al.

(10) Patent No.: US 8,629,752 B2
(45) Date of Patent: Jan. 14, 2014

(54) SUPPRESSOR

(75) Inventors: Jun-Hwan Jeong, Incheon (KR); Seung-Chul Lee, Incheon (KR); Yeon-Soo Chung, Incheon (KR); Gug-Ho Yoon, Gyeonggi-do (KR)

(73) Assignee: Amotech Co., Ltd., Incheon (KR)

( * ) Notice: Subject to any disclaimer, the term of this patent is extended or adjusted under 35 U.S.C. 154(b) by 0 days.

(21) Appl. No.: 13/545,797

(22) Filed: Jul. 10, 2012

(65) Prior Publication Data

US 2013/0015942 A1 Jan. 17, 2013

(30) Foreign Application Priority Data

Jul. 11, 2011 (KR) ..... 10-2011-0068263
Jun. 19, 2012 (KR) ..... 10-2012-0065673

(51) Int. Cl.
*H01C 7/10* (2006.01)

(52) U.S. Cl.
USPC ..... 338/21; 338/13

(58) Field of Classification Search
USPC ..... 338/21, 13
See application file for complete search history.

(56) References Cited

U.S. PATENT DOCUMENTS

| | | | | |
|---|---|---|---|---|
| 5,231,269 | A * | 7/1993 | Oku et al. | 219/730 |
| 5,476,714 | A * | 12/1995 | Hyatt | 428/402 |
| 5,976,420 | A | 11/1999 | Nakamura et al. | |
| 7,843,308 | B2 * | 11/2010 | Pachla et al. | 338/21 |
| 2010/0309595 | A1 * | 12/2010 | Adachi et al. | 361/56 |
| 2012/0236450 | A1 * | 9/2012 | Adachi | 361/56 |

FOREIGN PATENT DOCUMENTS

| | | | |
|---|---|---|---|
| KR | 10-2006-0026686 | A | 3/2006 |
| KR | 20090021433 | A | 3/2009 |
| KR | 20090081588 | A | 7/2009 |

* cited by examiner

*Primary Examiner* — Kyung Lee
(74) *Attorney, Agent, or Firm* — Wells St. John P.S.

(57) ABSTRACT

This invention relates to a suppressor, including an element having sheets printed with a first internal electrode and a second internal electrode, and a discharge material disposed in a gap between the first internal electrode and the second internal electrode, wherein the discharge material is composed of a SiC—ZnO-based component, in which ZnO is reacted with the surface of SiC, thereby imparting much higher insulating properties and improving ESD resistance.

5 Claims, 4 Drawing Sheets

SUPPRESSOR

CROSS-REFERENCES TO RELATED APPLICATION

This application claims the benefit of Korean Patent Application Nos. KR 10-2011-0068263, filed Jul. 11, 2011 and KR 10-2012-0065673, filed Jun. 19, 2012, which are hereby incorporated by reference in their entirety into this application.

BACKGROUND OF THE INVENTION

1. Technical Field

The present invention relates to a suppressor, and more particularly to a suppressor which protects internal circuits from static electricity.

2. Description of the Related Art

A varistor is used to protect circuits from abnormal voltage. A varistor is widely utilized as a protective device for protecting important electronic parts and circuits from overvoltage (surge voltage) and static electricity because resistance varies depending on the applied voltage.

In addition, an ESD (ElectroStatic Discharge) absorber exemplifies removing overvoltage and static electricity. Typically, an ESD absorber is configured such that a predetermined empty space is formed between internal electrodes to block comparatively large overvoltage or overcurrent. As such, an ESD denotes static electricity.

However, there are many cases where the suppression operation at low ESD voltage performed by a varistor is not satisfactory, and an ESD absorber shows superior suppression performance in proportion to the increase in ESD voltage but does not operate at low ESD voltage (e.g. an ESD of about 3 KV or less).

Also, a conventional suppressor which protects internal circuits from static electricity is configured such that an element is made of LTCC (Low Temperature Co-fired Ceramic), a discharge material is formed of varistor calcination powder, silver (Ag) and glass, and internal electrodes are formed of Ag and Pd. Hence, this suppressor is favorable in terms of low-temperature sintering but is problematic because it is weak in ESD and causes a short upon DC loading and also because the discharge material may react with the internal electrodes.

Prior techniques related thereto include Korean Patent No. 10-0672235 (2007.01.22) entitled Varistor and Method of Manufacturing the Same.

SUMMARY OF THE INVENTION

Accordingly, an object of the present invention is to provide a suppressor which has improved ESD resistance thanks to the development of a discharge material which imparts much higher insulating properties because ZnO is reacted with the surface of SiC.

In order to accomplish the above object, the present invention provides suppressor, comprising an element including a first internal electrode and a second internal electrode, and a discharge material disposed in a gap between the first internal electrode and the second internal electrode, wherein the discharge material includes a SiC—ZnO-based component.

The discharge material may include not less than 75 wt % but less than 100 wt % of SiC and greater than 0 wt % but not greater than 25 wt % of ZnO.

The element may include a LTCC material.

The discharge material may be fired using thermal treatment, so that a SiC—ZnO reaction layer is formed on the surface of SiC.

The discharge material may be printed in powder form on at least one of the first internal electrode and the second internal electrode and may be co-fired with the element.

The first internal electrode and the second internal electrode may include one or more selected from among Ag and Pd.

BRIEF DESCRIPTION OF THE DRAWINGS

The above and other objects, features and advantages of the present invention will be more clearly understood from the following detailed description taken in conjunction with the accompanying drawings, in which.

FIG. (a), (b) and (c) of 1 illustrate preferred examples of a suppressor according to the present invention.

DESCRIPTION OF THE PREFERRED EMBODIMENTS

Figure 1:
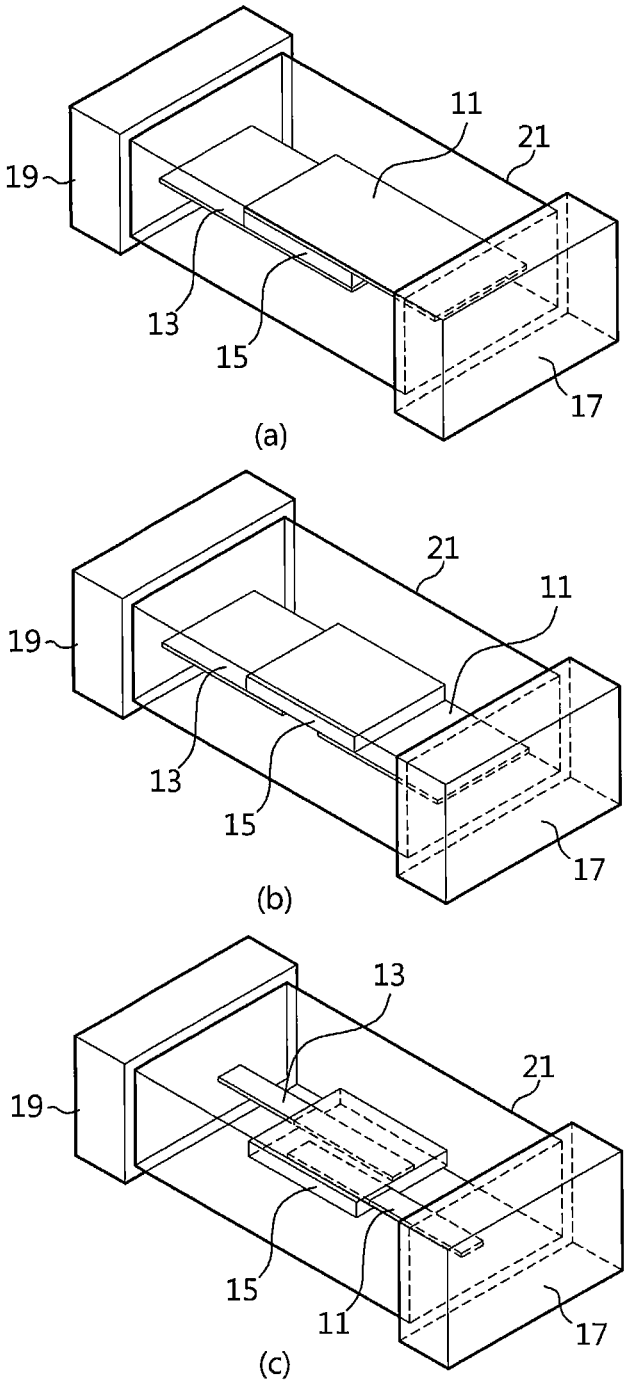

Hereinafter, preferred embodiments of the present invention will be described in detail with reference to the appended drawings.

According to the present invention, a suppressor includes a first internal electrode 11, a second internal electrode 13, and a discharge material 15 which is disposed in a gap between the internal electrodes. As such, the discharge material 15 is made of a SiC—ZnO-based component.

A variety of examples of the arrangement of the first and second internal electrodes and the discharge material are illustrated.

In a first example as illustrated in FIG. (a) of 1, the first internal electrode 11 and the second internal electrode 13 are disposed so as to partially overlap with each other, and the discharge material 15 is disposed between the overlapping first and second internal electrodes 11, 13. Specifically, the first internal electrode 11 and the second internal electrode 13 are vertically spaced apart from each other by a predetermined interval so that the first internal electrode 11 and the second internal electrode 13 partially overlap, and the discharge material 15 is disposed between these overlapping electrodes.

In a second example as illustrated in FIG. (b) of 1, the first internal electrode 11 and the second internal electrode 13 are spaced apart from each other in a single line, and the discharge material 15 is disposed on a portion of the first internal electrode 11 and on a portion of the second internal electrode 13, which face each other.

In a third example as illustrated in FIG. (c) of 1, the first internal electrode 11 and the second internal electrode 13 are disposed so as to partially overlap with each other, and the discharge material 15 is disposed to cover the first internal electrode 11 and the second internal electrode 13 so that the overlapping region of the first internal electrode 11 and the second internal electrode 13 is included in the discharge material.

The first example is a basic structure in which the discharge material 15 is disposed at the first internal electrode 11 and the second internal electrode 13, and the second example is a structure which reduces capacitance and increases ESD resistance, and the third example is a structure which decreases operating voltage in addition to reducing capacitance and increasing ESD resistance.

One end of the first internal electrode 11 is electrically connected to a first external electrode 17, and one end of the second internal electrode 13 is electrically connected to a second external electrode 19. The external electrodes include one or more selected from among Ag, Ni, and Sn.

The first internal electrode 11 and the second internal electrode 13 are made of a conductive material.

The first internal electrode 11 and the second internal electrode 13 include one or more selected from among Ag and Pd.

Ag is advantageous in terms of superior electrical conductivity, low resistance, and low-temperature sintering properties.

The compositions of the first internal electrode 11 and the second internal electrode 13 may be 100 wt % of Ag. In the case where both the first internal electrode 11 and the second internal electrode 13 are made of 100 wt % of Ag, Ag ions are emitted depending on the conditions of applied voltage, humidity, temperature, etc., upon operating semiconductor chip, and the emitted Ag ions react with the discharge material, thus forming an Ag path at a portion of the discharge material. The formation of the Ag path converts the discharge material which is non-conductive into a conductor to thus cause a short and deteriorate ESD resistance.

The first internal electrode 11 and the second internal electrode 13 may be composed of Ag and Pd. In the case where the first internal electrode 11 and the second internal electrode 13 are made of Ag and Pd, if the amount of Ag is greater than 99.5 wt % based on the total weight of the internal electrodes, an Ag path may be partially formed on the discharge material. In contrast, if the amount thereof is less than 80 wt %, electrical conductivity may decrease.

If the amount of Pd is less than 0.5 wt % based on the total weight of the internal electrodes, an Ag path may be partially formed on the discharge material, making it difficult to enhance ESD resistance. In contrast, if the amount thereof is greater than 20 wt %, the amount of Ag may be comparatively decreased, undesirably lowering electrical conductivity.

The operating conditions of a suppressor include a low dielectric constant, electrical non-conductivity, and no short upon DC loading. To this end, the discharge material is disposed in a gap between the first internal electrode 11 and the second internal electrode 13.

The discharge material 15 prevents a short from happening over time via formation of an insulating layer between the internal electrodes made of either Ag or Ag and Pd.

The discharge material 15 is made of a SiC—ZnO-based component so as not to react with the first internal electrode 11 and the second internal electrode 13.

The SiC—ZnO-based discharge material is applied to block the Ag path. The partial Ag path which may be formed by the emission of Ag ions from the internal electrodes converts the discharge material which is non-conductive into a conductor, undesirably creating a short and deteriorating ESD resistance.

SiC (silicon carbide) has superior thermal stability, high stability in an oxidation atmosphere, and predetermined electrical conductivity and thermal conductivity, with a low dielectric constant.

ZnO has superior non-linear resistance properties and discharge properties.

Both SiC and ZnO have electrical conductivity when used separately. However, when these are mixed and fired, ZnO is bound to the surfaces of SiC particles, thus forming an insulating layer having non-conductivity.

Figure 2:
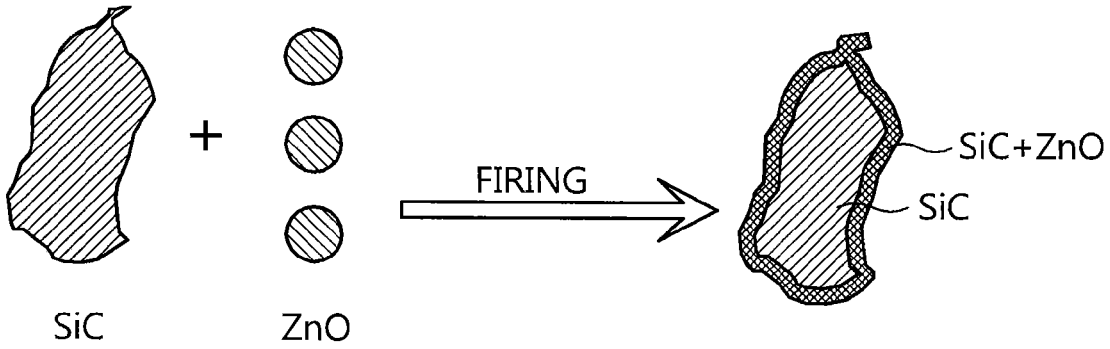
FIG. 2 schematically illustrates a SiC—ZnO reaction layer formed by reacting ZnO with the surface of SiC.

As is illustrated in FIG. 2, the insulating layer is formed by thoroughly reacting SiC with ZnO so that a SiC—ZnO reaction layer is formed on the surfaces of SiC particles. The insulating layer blocks the Ag path and thus imparts higher insulating properties to the discharge material, and improves ESD resistance thus solving DC short problems when mounting a suppressor to electronic parts.

Also, as the suppressor has improved ESD resistance, it is easy to control the capacitance, making it possible to manufacture a suppressor sample having 0.1 pF or less. Capacitance increases in proportion to the size of the area of overlap between the first internal electrode 11 and the second internal electrode 13. Hence, capacitance may be controlled by decreasing the size of the overlap or adjusting the number of internal electrodes.

The discharge material 15 includes not less than 75 wt % but less than 100 wt % of SiC, and greater than 0 wt % but not greater than 25 wt % of ZnO. The ratio of the amounts of SiC and ZnO in the discharge material is set in a range that forms a SiC—ZnO reaction layer on the surface of SiC by thoroughly reacting SiC with ZnO.

An insulating layer having non-conductivity is formed only when ZnO which causes a short is not left behind after the reaction of SiC and ZnO. When the discharge material is composed exclusively of SiC or when ZnO is left behind due to the incomplete reaction of SiC and ZnO, a short may occur.

When the discharge material 15 is composed of 100 wt % of SiC, a short may occur because of conductive SiC. If the amount of SiC is less than 75 wt %, the amount of ZnO may be comparatively increased and thus unreacted ZnO may be left behind, undesirably causing a short or deteriorating the ESD resistance. Likewise, if the amount of ZnO is greater than 25 wt %, the amount of SiC may be comparatively increased, and thus unreacted ZnO may be left behind, undesirably causing a short.

The discharge material contains SiC and ZnO, and may include a small amount of inevitably mixed impurities depending on the situation including manufacturing equipment, etc.

The discharge material 15 is synthesized using thermal treatment, or by performing co-firing with an element while not carrying out thermal treatment. Thermal treatment of the discharge material may be conducted at a low temperature of 800~1000° C. If thermal treatment is carried out at a temperature less than 800° C., the reaction of SiC and ZnO does not sufficiently take place, making it impossible to form the SiC—ZnO reaction layer on the surfaces of SiC particles. Taking into consideration the manufacturing conditions in the chip phase, thermal treatment at a temperature higher than 1000° C. is unfavorable in terms of cost.

The element 21 includes sheets made of LTCC (Low Temperature Co-fired Ceramic). The sheets are printed with the first internal electrode 11 and the second internal electrode 13.

The LTCC material is advantageous because of performing low-temperature sintering and achieving miniaturization, high functionality and complexity of high-frequency parts. LTCC may be sintered at 1000° C. or less corresponding to the level of about 50~65% of 1300~1600° C. that is the sintering temperature of general ceramic. The LTCC material may include $SiO_2$ or $Al_2O_3$.

FIG. (a), (b) and (c) of 1 illustrate a single first internal electrode 11 and a single second internal electrode 13, but may be regarded as a plurality of first internal electrodes 11 and a plurality of second internal electrodes 13 being layered in alternation. As such, the number of electrodes is not limited and may vary depending on desired capacitance properties.

Below is a method of manufacturing the suppressor.

To manufacture a plurality of sheets of an element which may form the suppressor, a slurry is first prepared. For example, a solvent such as water or alcohol is added to a $SiO_2$ or $Al_2O_3$ based LTCC material and then the resulting mixture is ball milled for 24 hr, thus preparing material powder.

Subsequently, a PVB-based binder as an additive is weighed in an amount of about 6 wt % relative to the material powder and then dissolved in a toluene/alcohol-based solvent, and the resulting solution is added to the material powder prepared as above. Subsequently, milling for about 24 hr using a small ball mill and mixing are performed, thus preparing a slurry. The numerals mentioned above are merely illustrative and may vary depending on the preparation conditions and the needs.

Such a slurry is processed using a doctor blade or the like thus forming a sheet having the desired thickness (e.g. about 15 μm). The formed sheet is cut to a unit of desired length, thus making a plurality of sheets.

The reason why the thickness of the sheet is set to about 15 μm takes into consideration shrinkage in the subsequent layering, compression and firing processes. When the subsequent layering, compression and firing processes are carried out, respective sheets with a thickness of about 10 μm are produced.

Next, respective sheets are printed with a first internal electrode and a second internal electrode. The first internal electrode and the second internal electrode are printed with a paste using Ag and Pd powder.

Next, the second internal electrode is positioned as the lowermost layer and the discharge material is disposed thereon, after which the first internal electrode is layered on the discharge material. Thereby, the plurality of internal electrodes is layered to make an element, which is then compressed. Upon layering and compression, a pressure of about 500~3000 psi is used.

As such, the discharge material formed by mixing SiC powder and ZnO powder at a ratio of 3:1 or 4:1 and then performing thermal treatment may be disposed on the second internal electrode. Alternatively, SiC powder and ZnO powder may be mixed at a ratio of 3:1 or 4:1 without thermal treatment, after which the resulting powder mixture may be printed on the second internal electrode and then co-fired with the element.

Next, the element formed via layering and compression is subjected to degreasing and firing. A degreasing process is performed at about 300° C., after which a firing process is carried out at about 800~1000° C.

The layering, compression and firing processes are sequentially carried out as above, so that the discharge material includes the SiC—ZnO reaction layer, and the SiC—ZnO reaction layer blocks the Ag path, thereby manufacturing a suppressor having improved ESD resistance.

Hereinafter, the present invention is described in more detail via the following tests, but is not limited to the tests.

<Test 1>

ESD Resistance Evaluation Test

Test Method: A suppressor was mounted on a PCB, and leakage current after application of ESD was measured 100 times per applied voltage.

Table 1 below shows leakage current (μA) when using 100 wt % of SiC as a discharge material.

TABLE 1

| No. | 8 kV | 15 kV | 20 kV | 30 kV |
|---|---|---|---|---|
| 1 | 0.001 | 0.026 | 0.972 | 1434 |
| 2 | 0.401 | 0.598 | 0.311 | 9.953 |
| 3 | 0.006 | 0.359 | 0.371 | 839 |
| 4 | 0.001 | 2.322 | 2.521 | 3551 |
| 5 | 0.007 | 0.919 | 0.009 | 3.152 |
| 6 | 0.038 | 0.024 | 2.265 | 7915 |
| 7 | 0.001 | 0.124 | 5.741 | 4.089 |
| 8 | 0.004 | 254 | 4437 | 38.751 |
| 9 | 0.001 | 668 | 81.187 | 9574 |
| 10 | 0.001 | 0.006 | 0.916 | 51.283 |
| Min. | 0.001 | 0.006 | 0.009 | 3.152 |
| Avg. | 0.0461 | 92.6378 | 453.129 | 2342.02 |
| Max. | 0.401 | 668 | 4437 | 9574 |
| Short upon DC loading (%) | 1.37 | 2.1 | 2.8 | 2.5 |

Table 2 below shows leakage current (μA) when using a SiC+ZnO discharge material including SiC and ZnO at 4:1.

TABLE 2

| No. | 8 kV | 15 kV | 20 kV | 30 kV |
|---|---|---|---|---|
| 1 | 0.001 | 0.001 | 0.065 | 2.519 |
| 2 | 0.001 | 0.004 | 0.195 | 3.766 |
| 3 | 0.001 | 0.001 | 0.001 | 0.005 |
| 4 | 0.001 | 0.006 | 0.004 | 0.565 |
| 5 | 0.001 | 0.059 | 0.005 | 0.002 |
| 6 | 0.001 | 0.022 | 0.001 | 0.049 |
| 7 | 0.001 | 0.001 | 0.216 | 0.117 |
| 8 | 0.001 | 0.001 | 0.002 | 3.246 |
| 9 | 0.005 | 0.015 | 0.002 | 0.031 |
| 10 | 0.001 | 0.003 | 0.001 | 0.086 |
| Min. | 0.001 | 0.001 | 0.001 | 0.002 |
| Avg. | 0.0014 | 0.0113 | 0.0492 | 1.0386 |
| Max. | 0.005 | 0.059 | 0.216 | 3.766 |
| Short upon DC loading (%) | 0.00 | 0.00 | 0.00 | 0.00 |

As is apparent from Tables 1 and 2, when 100 wt % of SiC was used as the discharge material, leakage current was high and a short occurred upon DC loading.

Whereas, when the discharge material composed of SiC and ZnO at 4:1 was used, leakage current was minimized and a short did not occur. The use of SiC+ZnO discharge material resulted in superior ESD resistance and prevented short.

<Test 2>

SiC+ZnO Reactivity Evaluation Test

Test Method: Respective discharge materials SiC 100 wt %, SiC:ZnO=1:1, SiC:ZnO=2:1, SiC:ZnO=3:1, and SiC:ZnO=4:1 were thermally treated at 850° C. and thus SiC+ZnO reactivity was evaluated.

Figure 3:
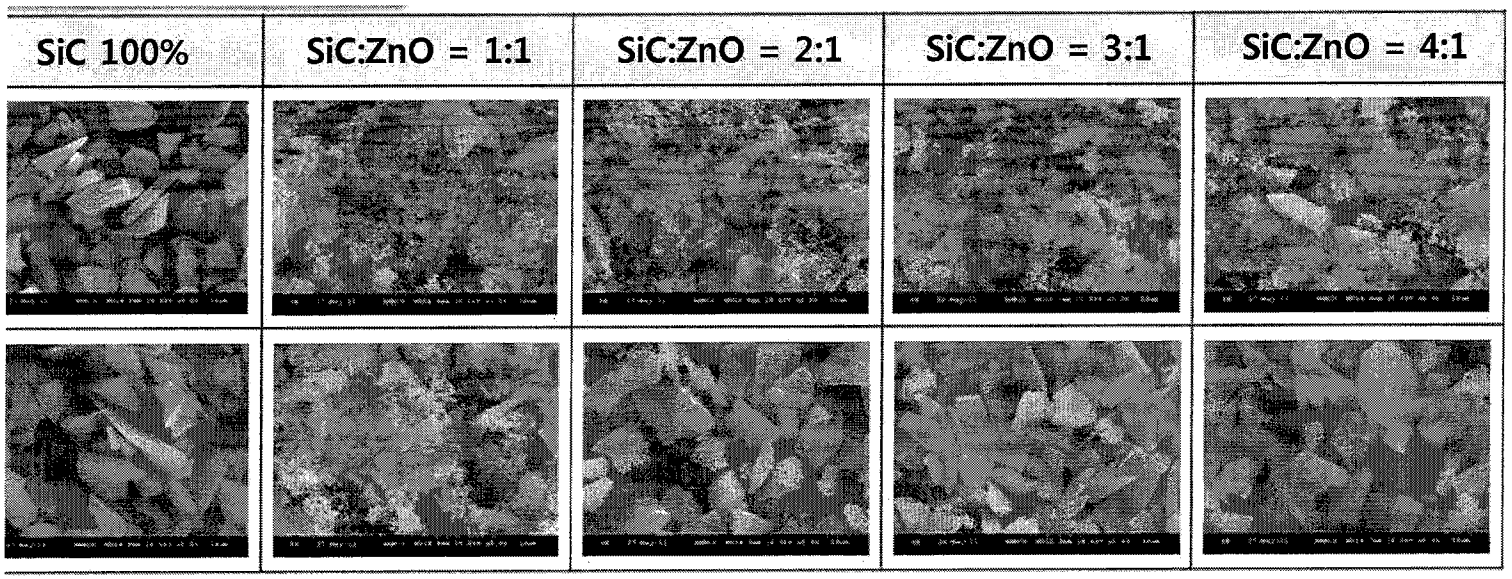
FIG. 3 illustrates structures which show reactivity between SiC and ZnO.

As shown in FIG. 3, the case of SiC 100 wt % exhibited no reactivity, and in the cases of SiC:ZnO=1:1 and SiC:ZnO=2:1, ZnO particles which cause a short were left behind after reaction.

In the cases of SiC:ZnO=3:1 and SiC:ZnO=4:1, ZnO and SiC were thoroughly reacted thus completely removing ZnO particles.

Accordingly, it is preferred that the discharge material include not less than 75 wt % but less than 100 wt % of SiC and greater than 0 wt % but not greater than 25 wt % of ZnO.

Figure 4:
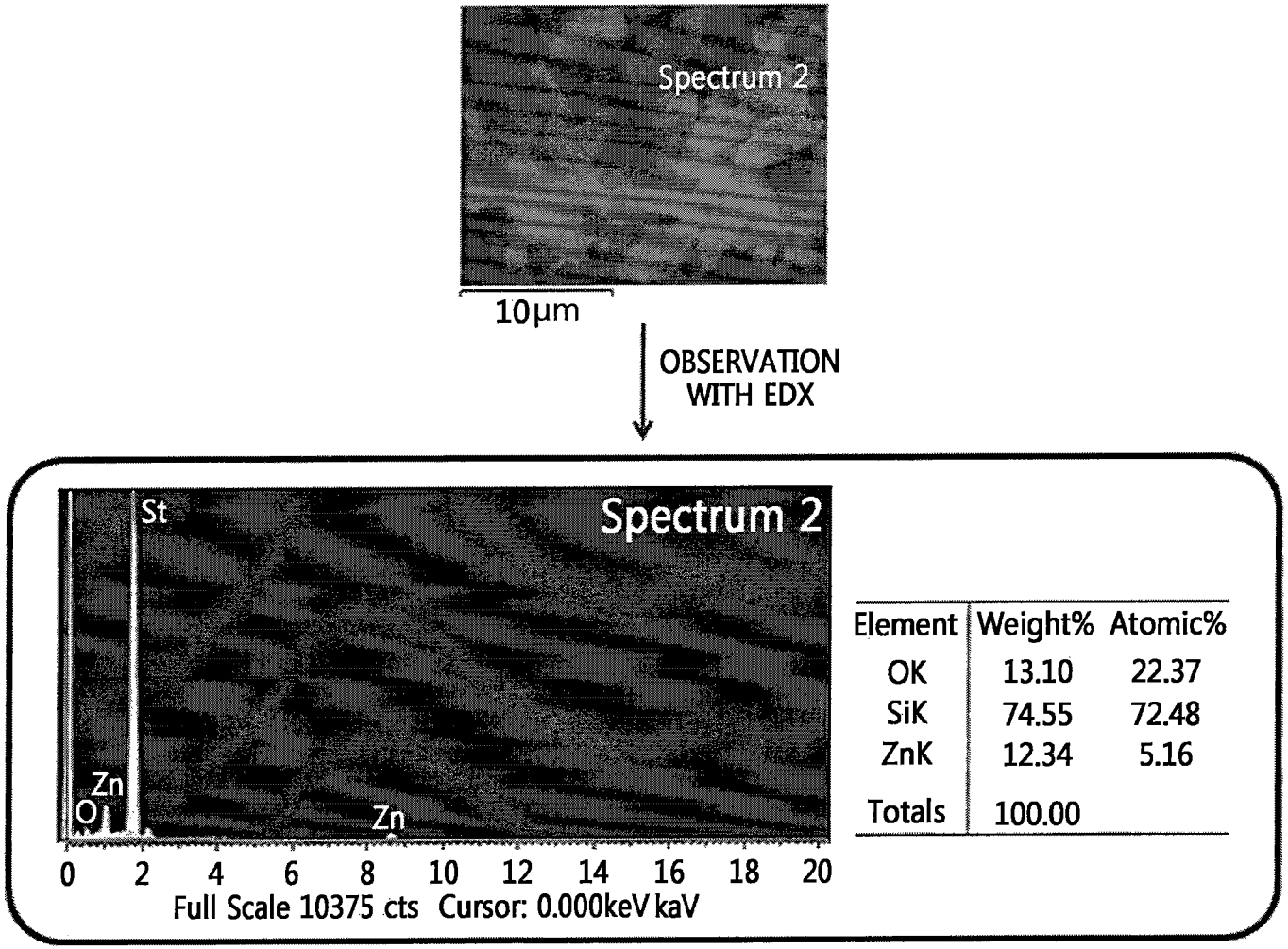
FIG. 4 is a graph illustrating the discharge material comprising SiC and ZnO at 4:1, as observed with EDX.

FIG. 4 is a graph illustrating the discharge material composed of SiC and ZnO at 4:1, as observed with EDX. EDX is a tester in which a scanning electron microscope and an energy diffusive X-ray spectrometer are combined.

As illustrated in FIG. 4, ZnO completely removed after reaction was detected, from which a SiC+ZnO reaction layer was proven to be formed.

As described hereinbefore, the present invention provides a suppressor. According to the present invention, the suppressor includes a discharge material which is composed of a SiC—ZnO-based component, so that a SiC—ZnO reaction layer, which is an insulating layer, is formed on the surfaces of SiC particles, thereby improving ESD resistance and preventing a short from happening upon DC loading.

Also when the discharge material according to the present invention is used, the resulting SiC—ZnO reaction layer can impart much higher insulating properties, thus facilitating the control of capacitance and making it possible to manufacture a sample having 0.1 pF or less.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A suppressor, comprising:

an element including a first internal electrode and a second internal electrode;

a discharge material disposed in a gap between the first internal electrode and the second internal electrode;

wherein the discharge material includes a SiC—ZnO-based component; and wherein the discharge material is fired using thermal treatment, so that a SiC—ZnO reaction layer is formed on a surface of SiC.

2. The suppressor of claim 1, wherein the discharge material comprises not less than 75 wt % but less than 100 wt % of SiC and greater than 0 wt % but not greater than 25 wt % of ZnO.

3. The suppressor of claim 1, wherein the element includes a LTCC (Low Temperature Co-fired Ceramic) material.

4. The suppressor of claim 1, wherein the discharge material is printed in powder form on at least one of the first internal electrode and the second internal electrode and is co-fired with the element.

5. The suppressor of claim 1, wherein the first internal electrode and the second internal electrode include one or more selected from among Ag and Pd.

* * * * *